US009788636B2

(12) United States Patent
von Jan et al.

(10) Patent No.: US 9,788,636 B2
(45) Date of Patent: Oct. 17, 2017

(54) APPLICATOR WITH AN INTERNAL PASSIVE RESERVOIR DELIMITED BY WINGS

(71) Applicant: GEKA GmbH, Bechhofen (DE)

(72) Inventors: Martin von Jan, Schwabach (DE); Werner Fischer, Burk (DE)

(73) Assignee: GEKA GmbH, Bechhofen (DE)

( * ) Notice: Subject to any disclaimer, the term of this patent is extended or adjusted under 35 U.S.C. 154(b) by 211 days.

(21) Appl. No.: 14/668,966

(22) Filed: Mar. 25, 2015

(65) Prior Publication Data

US 2015/0272298 A1 Oct. 1, 2015

(30) Foreign Application Priority Data

Mar. 26, 2014 (DE) ..... 20 2014 101 412 U
May 7, 2014 (DE) ..... 20 2014 102 118 U

(51) Int. Cl.

| | |
|---|---|
| ***A45D 40/26*** | (2006.01) |
| ***A45D 34/04*** | (2006.01) |
| *A45D 34/00* | (2006.01) |
| *A45D 40/00* | (2006.01) |

(52) U.S. Cl.

CPC ..... *A45D 40/262* (2013.01); *A45D 34/04* (2013.01); *A45D 40/26* (2013.01); *A45D 40/265* (2013.01); *A45D 2034/007* (2013.01); *A45D 2040/0012* (2013.01)

(58) Field of Classification Search

None

See application file for complete search history.

(56) References Cited

U.S. PATENT DOCUMENTS

| | | | | |
|---|---|---|---|---|
| 1,824,994 | A * | 9/1931 | Dawson | A46B 5/00 15/104.9 |
| 2,681,463 | A | 6/1954 | Gordon | |
| 2,772,430 | A * | 12/1956 | Moritt | A47L 17/00 15/111 |
| 2,828,502 | A * | 4/1958 | Tupper | A47L 17/00 15/121 |
| 8,191,559 | B2 * | 6/2012 | Bickford | A45D 34/045 132/218 |
| 2007/0048066 | A1 * | 3/2007 | Dumler | A45D 40/265 401/130 |

FOREIGN PATENT DOCUMENTS

| | | |
|---|---|---|
| EP | 0436264 A1 | 7/1991 |
| EP | 0727160 A1 | 8/1996 |
| WO | 2010066748 A1 | 6/2010 |

OTHER PUBLICATIONS

Search Report from the German Patent & Trademark Office for DE 20 2014 102 118.3 dated Nov. 5, 2014.

* cited by examiner

*Primary Examiner* — David Walczak

(57) ABSTRACT

An applicator, and in particular a lip applicator, for applying a cosmetic onto the skin, comprising a preferably elongate applicator body extending along a longitudinal applicator axis and a bristle-free jacket surface surrounding it which serves, at least in some sections, for applying and distributing the cosmetic on the skin, wherein the applicator body has several wings, characterized in that the wings distally each have a freely projecting end and the wings are, in their entirety, preferably disposed along an annular line and the wings form between them a mass storage unit.

18 Claims, 4 Drawing Sheets

APPLICATOR WITH AN INTERNAL PASSIVE RESERVOIR DELIMITED BY WINGS

FIELD OF THE INVENTION

The invention relates to applicators, particularly lip applicators, for applying a cosmetic onto the skin.

BACKGROUND OF THE INVENTION

The invention relates both to applicators in the healthcare field and to cosmetics applicators.

Such cosmetics applicators are used particularly as applicators for applying lip cosmetics, e.g. lip gloss, or lip care products. Such applicators, in particular, are required to enable a selective application so that the lip gloss or the lip care product reaches only those areas that actually are to be subjected to a treatment and do not inadvertently "smear".

The problem with such cosmetics applicators in practice is that a relatively large amount of cosmetic mass is required for each application process.

The conventional applicators, in which the cosmetic mass to be applied is in each case only stored by adhesion to the applicator surface, have to be dipped into the cosmetics supply repeatedly and "newly charged" in this manner several times in a row in order to carry out an entire application process. This bothers many users.

Another attempt to provide a remedy for this is represented by the concept of an internally supplied applicator, in which a fluid connection is established between the actual applicator portion, by means of which the application is performed, and the cosmetics storage container, in such a way that only little pressure has to be exerted on the storage container during application in order to dispense more cosmetic mass on the applicator. Thus, the applicator can be "recharged" without having to put it down and dip it into the cosmetics supply again.

One immanent problem of this solution is that the applicator becomes heavy and relatively unwieldy, because the cosmetics supply always has to be carried along, which is typically done by the handle of the cosmetics applicator being configured to be enlarged and now serving as a cosmetics storage container.

The fact that pressure must be exerted onto the handle during application in order to dispense more cosmetic mass constitutes another problem of this approach. Many users perceive this as being disadvantageous; they report that the exertion of pressure on the handle during application occasionally results in inadvertent movements of the actual applicator portion, which in unfavorable cases leads to unwanted smearing.

In order to solve the problem, a series of electromotively operated applicators powered by batteries or rechargeable batteries have been proposed. In these cases, the applicator portion is supplied with cosmetic mass by means of a pump at the push of a button. Due to their frequently poor reliability (unexpectedly empty rechargeable batteries/batteries, sticking, in the case of only sporadic use), and not least for price-related reasons, such solutions were unable to establish themselves so far.

In view of this, the invention is based on the object of providing a cosmetics applicator with which a larger amount of cosmetic mass can be applied without having to dip the applicator into the cosmetics supply occasionally, wherein the applicator is configured in a simple and functionally reliable manner.

SUMMARY OF THE INVENTION

Accordingly, an applicator, and in particular a cosmetics, and even more specifically, a lip applicator, is proposed for applying a cosmetic onto the skin, and preferably onto the substantially hairless skin. The cosmetics applicator has a preferably elongate applicator body extending along a longitudinal applicator axis, i.e. an applicator body whose greatest extent runs in the direction parallel to the longitudinal axis. The applicator body has a bristle-free jacket surface surrounding it. The latter serves, at least in some sections, for applying and distributing the cosmetic on the skin. According to the invention, the applicator body has several wings, i.e. portions which, viewed in the circumferential direction, are respectively separated from one another by a preferably continuous gap. Each of the wings has an end that distally projects freely and, viewed along the longitudinal axis, freely across the core in an outward direction. In their entirety, the wings are disposed at least substantially along an annular line so that, between them, they delimit a central region encircled by them, which forms a mass storage unit. Preferably, each of the wings is bristle-free. Ideally, each wing is configured in such a way that, compared with the rest of the wing, its distal end, i.e. the free end directed away from the side of the handle, has the maximum distance from the longitudinal applicator axis in the radial direction. In that case, the wing is configured in such a way that, progressing from its root to its distal end, it has an increasingly large distance from the longitudinal applicator axis.

Preferably, one, better each of the wings is flexible to a more than just insubstantial extent in the radially inward direction. In any case, a more than insubstantial flexibility is provided if the corresponding wing can be displaced with its distal end under a pressure that is common for application by an amount of at least 1 mm, better at least 1.5 mm in an elastically reversible manner in the radially inward direction.

Preferably at least one, better each, of the wings extends obliquely outwards relative to the longitudinal applicator axis. In this case, it is particularly preferred if all wings extend obliquely outwards in different directions, with the wings ideally being curved concavely outwards over at least the predominant part of their length in a direction whose projection corresponds to the direction of the longitudinal axis. The wings thereby obtain, as it were, a "spoon shape", which facilitates the handling and transport of the mass to be applied. Moreover, this results in the distal ends of the wings being situated as far apart as possible, which makes it possible, for the sharply-contoured application, to work only with the outer surface of one of the wings without risking the inadvertent application by means of the other wings of mass onto main areas that are exempt from the application.

Within the context of a particularly preferred exemplary embodiment, it is provided that the outer surface of each wing is convexly curved in the circumferential direction, which facilitates working with the outer surface of the wing.

Ideally, 4 to 6 wings are provided.

Preferably, the applicator is configured in such a way that the inner space peripherally enclosed by the wings becomes increasingly larger, preferably continuously, from the wing roots towards the distal ends of the wings.

A preferred exemplary embodiment provides that each of the wings has an end rounded in the circumferential direction, and the region over which the rounded portion extends is preferably at least ⅙ of the length of a wing from the distal wing tip to the proximal wing root. Without it giving rise to an unpleasant tactile impression, the respective wing is thus given a kind of tip with which the application can be carried out very precisely and small-scale, which is important not least in the application of lip cosmetics that achieve a "lip gloss effect".

Preferably, the wall thickness of each wing —predominantly or even substantially, measured perpendicularly to the local surface —is less than or equal to 1.25 mm, or less than or equal to 0.75 mm. The high flexibility of the wing in the radial direction desired in accordance with the invention is thus achieved without a soft-elastic material having to he used necessarily.

Within the context of another preferred exemplary embodiment, it is provided that a gap, which narrows from the distal end of the wing towards the proximal end of the wing and which is preferably configured in an approximate V-shape, remains free between immediately adjacent wings in their state of rest. Such a gap has several functions. On the one hand, precisely such a gap ensures particularly well that the wings are able to move in the radial direction to a great extent without adjacent wings mutually impeding one another. On the other hand, such a gap facilitates the filling of the cavity with the cosmetic mass because the gap has a ventilating effect and thus prevents an air cushion from being able to remain in the cavity, as under a diving bell, by the cavity formed by the wings being pushed into the cosmetic mass.

Preferably, the wings each have a stem portion and a head portion, wherein the head portion, at least substantially or preferably everywhere, has a larger extent in the circumferential direction than the stem portion. An applicator is thus provided whose head portion provides a comparatively large surface area, which is, however, radially movable to a large extent due to the fact that it is held by a predominantly narrower stem portion.

A particularly preferred embodiment provides that the wings transition at their proximal end into a ring wall, which is substantially closed in the circumferential direction and which forms a cavity that is open substantially only at its proximal end face.

Ideally, the wings make up at least ⅓ of the length of the applicator body in the direction parallel to the longitudinal applicator axis, and the wings make up a maximum of ⅔ of the length of the applicator body in the direction parallel to the longitudinal applicator axis.

Within the context of a preferred embodiment, it is provided that the surface of the applicator that comes into contact with the skin and the substance to be applied during the application as intended is a smooth plastic surface. Smooth is in this case understood to mean a surface that appears visually smooth to the naked eye.

Within the context of another preferred embodiment, it is provided that the surface of the applicator that, during the application as intended, comes into contact with the skin and the substance to be applied as intended is equipped with a flock coating.

Further advantages, optional embodiments and mechanisms of action of the invention become apparent from the two exemplary embodiments described below with reference to the Figures.

DETAILED DESCRIPTION OF THE PREFERRED EMBODIMENTS

First Exemplary Embodiment

Figure 3:
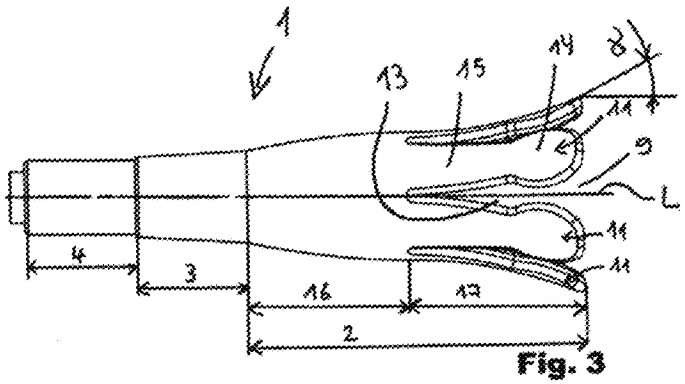
FIG. 3 shows a side view for the first exemplary embodiment.
Figure 1:
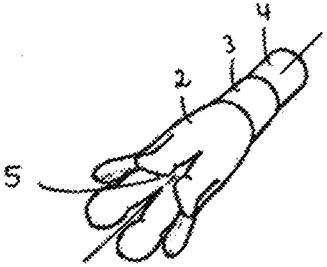
FIG. 1 shows a perspective view for the first exemplary embodiment, obliquely from the front.

FIG. 1 in conjunction with FIG. 3 offers a quick overview on how the first exemplary embodiment of the applicator according to the invention is configured.

The applicator 1 consists of an applicator body 2, which in this case transitions into a stem fitting portion 3. However, the presence of a stem fitting portion 3 is not an absolute necessity, but is useful. The stem fitting portion 3 in turn transitions into a coupling portion 4. The coupling portion 4 serves for coupling the applicator to a stem which in turn transitions into a handling means. In exceptional cases, the handling means can also be coupled directly to the coupling portion 4 or integrally transition into the stem fitting portion 3.

Figure 2:
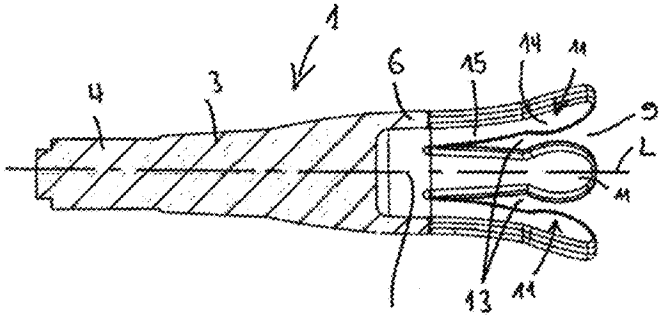
FIG. 2 shows a sectional view along the longitudinal axis L for the first exemplary embodiment.

As can best be seen in FIG. 2, the applicator has a pronounced longitudinal applicator axis L. The applicator has an elongate form, its greatest extent in the direction of the longitudinal axis L is preferably twice its extent in the direction perpendicular to the longitudinal axis L.

In the applicator 1 according to the invention, the applicator body 2 is, in the end, divided into two different portions, i.e. into a massive portion 16 and a wing portion 17. On its outer circumferential surface, the massive portion 16 is preferably configured to be bristle-free. It serves for being able to apply cosmetic mass. It thus differs from the stem fitting portion 3, which, due to its diameter, is generally reduced compared with the applicator body 2, and is practically hardly able any longer to contribute to the application of the cosmetic mass.

The massive portion 16 preferably has a slightly conical shape, or is configured in such a way that its diameter increases in the direction towards the wing portion 17.

Figure 4:
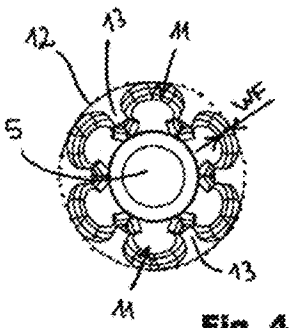
FIG. 4 shows a frontal view for the first exemplary embodiment from the front.

As can best be seen in the FIGS. 2 and 3, the wing portion 17 of the applicator body is formed by several wings 11 which may extend substantially parallel to the longitudinal axis L, but which preferably extend at a slight angle as described below. In any case, the wings 11 protrude over the distal end face (i.e. the end face facing away from the imaginary handling means) of the massive portion 16. Preferably, the wings diverge towards the distal end. The ends of the wings facing away from the side of the handling means are, in their entirety, disposed along an annular line 12 as it is indicated in FIG. 4 by the dotted line. Preferably, the wings, too, are bristle-free, preferably also on their outer side.

Preferably, 4 to 10, and ideally, 6 to 8 wings are used.

As can be seen, the wings in this exemplary embodiment are all of equal length and ideally even identical.

In this way, the wings 11 enclose between them a cavity 5 acting as a mass storage unit, which either has an approximately cylindrical volume or, as in this exemplary embodiment, an approximately conical volume. Expediently, no organs for retaining cosmetic mass, such as pins or fingers, are disposed within this volume—i.e. organs that would retain the cosmetic mass in the cosmetic storage unit by exhibiting a capillary effect and/or by the cosmetic mass adhering to them and therefore tending to be prevented from leaving the mass storage unit.

The individual wings 11 are flexible to a more than just insubstantial extent. Therefore, they bend, under the forces arising in the application as intended, to a certain extent inwards in the radial direction, preferably by carrying out, in each case as a whole, a perceptible pivoting movement about their base area.

Thus, the volume of the cavity 5 decreases, so that cosmetic mass escapes. In this case, the discharge of the cosmetic mass can of course be controlled. For the elasticity of the wings 11 is designed in such a way that the wings 11, when the applicator is brushed only gently over the area of the skin to be treated, do not deform to a substantial extent, so that hardly any cosmetic mass is discharged from the mass storage unit. If, however, the user applies a slightly firmer pressure, the decisive displacement of the wings 11 in the radially inward direction occurs, and thus the discharge of additional cosmetic mass from the mass storage unit.

In order to obtain this effect, the particularly preferred material for manufacturing the applicators according to the invention is not a rubber-elastic material but a plastic material capable of injection-molding, which is elastic, but slightly harder. Typical materials are polyethylene, in particular HDPE and the family of the plastics sold under the brand name GRILFLEX. Because it is precisely the use of such materials that ensures that the wings do not fold towards the inside prematurely.

Alternatively, the applicator can also be manufactured from polymethylpenthene, which is on the market under the brand name TPX. A group of materials which are very much suited for the manufacture of the applicator according to the invention are the thermoplastic elastomers (TPE), particularly in a vulcanized form (TPV).

Otherwise, it is to be noted that the flexibility of the wings 11 can be controlled rather well through its wall thickness WF; with respect to the wall thickness, see FIG. 4, in which WF is drawn in. As can be seen very well in FIG. 3, the wings in this exemplary embodiment are designed in such a way that the wall thickness of each wing is in the range of from 0.6 mm+/−0.3 mm.

It can be seen particularly well in FIGS. 2 and 3 that in this exemplary embodiment, each of the wings 11 extends outwards at a local angle $\alpha$ relative to the longitudinal applicator axis L. All wings 11 diverge or extend in different directions, obliquely outwards, so that a funnel-shaped or tulip-shaped wing arrangement is the result. In this exemplary embodiment, the wings 11 extend obliquely outward over their entire length.

In this exemplary embodiment, they are expediently curved concavely outwards in a direction whose projection perpendicular to the longitudinal axis corresponds to the direction of the longitudinal axis. In this way, a sensitive application can be carried out with the distally outer tips of the wings without the entire wing surface coming into contact with the area of the skin to be treated.

Expediently, each of the wings, on its outer surface, is convexly curved in the circumferential direction about the longitudinal applicator axis L. Each of the wings this offers a, so to speak, spherical outer surface, which results in a gentle touch on the skin and is perceived as pleasant.

As can again be seen well in FIGS. 1 to 3, the wing in this exemplary embodiment has a distal end rounded in the circumferential direction. The rounded portion is configured in a generous manner. It extends over at least one sixth of the entire length of a wing, measured from the distal wing tip to the proximal wing root, the length of a wing corresponding to the dimension line with the reference numeral 17 shown in FIG. 3. It is thus achieved that the wings 11 can be used for working very sensitively and exactly.

Due to the fact that the wings 11 taper towards their distal ends, the application can take place not only over a broad area, but in relatively narrow lines by bringing only the outermost area of a wing tip into contact with the skin.

It is particularly preferred if the wings 11 each have a stem portion 15 and a head portion 14. The head portion 14 is characterized in that, substantially everywhere, it has a larger extent in the circumferential direction than the stem portion 15, as FIG. 3, for example, shows very nicely. What this is supposed to mean can be understood when looking more closely at. FIG. 3: Each of the extents that the head portion 14 locally has in the circumferential direction is greater than the corresponding extent of the stem portion 15, even in its base area, with the exception of the narrow region in which the head portion 14 transitions with a constricted portion into the stem portion 15. The formation of such a pronounced head portion 14 divides the wing into two functional areas. The stern portion 15 ensures the necessary flexibility, the bead portion 14, which is reminiscent, also visually, of a small spoon to a certain extent, provides the surface which is mainly used for applying the cosmetic onto the skin, i.e. the surface with which the skin preferably comes into immediate contact.

It can also be seen rather well in the FIGS. 2 and 3 that a gap 13, which narrows over its predominant length from the distal end of the wing towards the proximal end of the wing, remains free between immediately adjacent wings in their state of rest (i.e. when the wings are not subjected to any loads). This configuration of the gap allows for a sufficient elastic mobility of each wing 11 in the radially inward direction. Moreover, the cavity delimited by the circularly disposed wings is ventilated through this gap, i.e. when the applicator 1 is dipped into the mass reservoir by means of a movement in the direction parallel to its longitudinal axis L, the air is not retained between the wings 11, as in a diving bell, but it can escape laterally through the gaps 13, so that the cosmetic mass can fill the cavity 5 (see FIG. 1).

As can be seen in FIG. 2, this embodiment is configured in such a way that the wings at their proximal end transition into a ring wall 6 substantially closed in the circumferential direction; see FIG. 2. Thus, a cavity which is closed entirely or at least substantially in the circumferential direction is formed in the applicator body 2 in the distal region behind the wings 11. The term substantially in this case means that the ring wall may possibly be provided with purely local openings serving for ventilation. In this exemplary embodiment, the openings are not shown in the Figures.

As can be seen rather clearly in FIG. 3, the wings 11 in this exemplary embodiment constitute more than a third of the total length of the applicator body 2 in the direction parallel to the longitudinal applicator axis L.

The outer surfaces of the wings, in particular, can be provided with generally molded-on bristles, or with loops. Preferably, they are totally smooth or flock-coated.

Second Exemplary Embodiment

FIGS. 5 to 8 show a second exemplary embodiment of the invention. As regards their function, the two exemplary embodiments are identical, so that the statements on the first exemplary embodiment also apply to this second exemplary embodiment unless otherwise provided by the differences between the two exemplary embodiments described hereinafter.

The first difference clearly visible from the Figures lies in the fact that only four wings are used in this exemplary embodiment instead of the six wings of the first exemplary embodiment. However, the wings are disposed in their entirety with their wing roots along an annular line 12 also in this exemplary embodiment, so that these wings also form between them a cavity 5; see the dotted line in FIG. 8.

Figure 7:
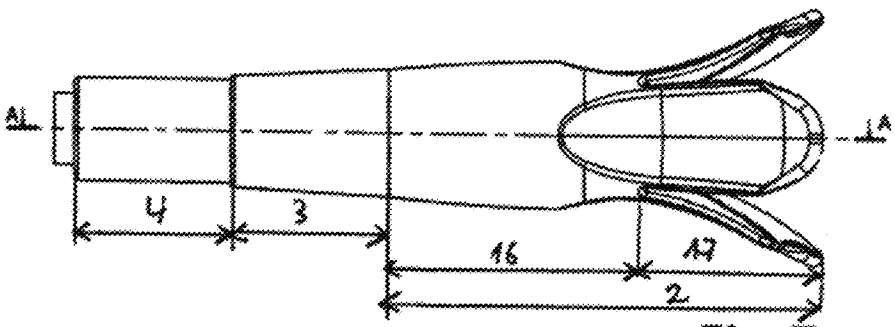
FIG. 7 shows a side view for the second exemplary embodiment.
Figure 6:
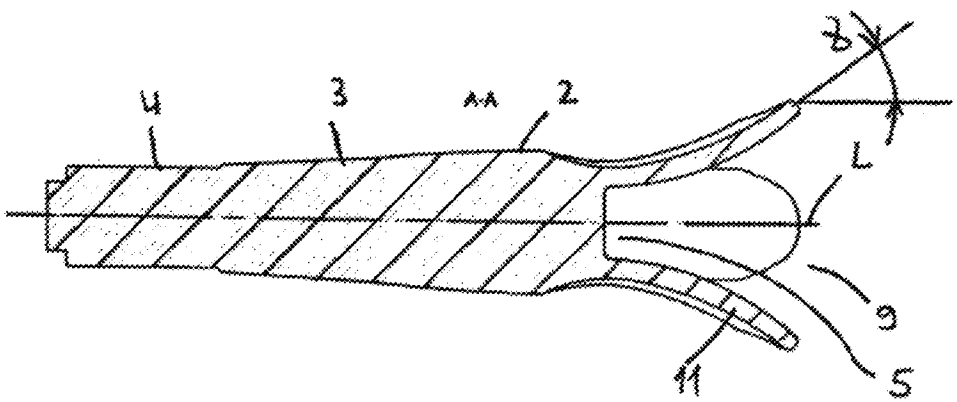
FIG. 6 shows a sectional view along the longitudinal axis L for the second exemplary embodiment.
Figure 8:
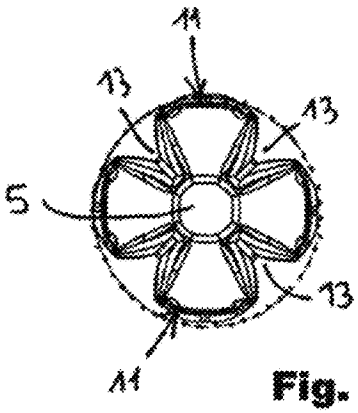
FIG. 8 shows a frontal view for the second exemplary embodiment and the third exemplary embodiment being a simple variation of the second one, seen from the front.
Figure 5:
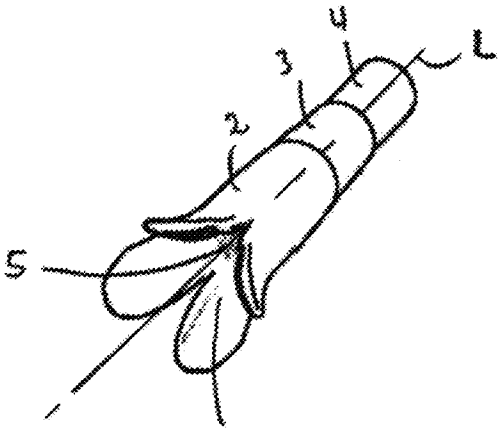
FIG. 5 shows a perspective view for the second exemplary embodiment and the third exemplary embodiment being a simple variation of the second one, seen obliquely from the front.

The applicator body 2 is divided into a massive portion 16 and a wing portion 17 also in this exemplary embodiment; see FIG. 7.

Here, the massive portion 16 has a slightly conical shape, or is configured in such a way that its diameter increases in the direction towards the wing portion 17. However, in contrast to the first exemplary embodiment, the diameter of the applicator body, over its further extent, first drops again by at least 10% starting from the beginning of the wing portion 17, as is best shown in FIG. 3.

Another interesting difference is that the wings 11 in this exemplary embodiment have not been convexly curved in the circumferential direction, but preferably have a slightly concave curve. Since the wings 11 are also, just like in the first exemplary embodiment, concavely curved outwards over at least the predominant part of their length in a direction whose projection corresponds to the direction of the longitudinal axis, they, seen from outside, have a shape that can best be described as a spoon shape, i.e. the wings form a local depression that can serve as a mass storage unit on the outer side. This function is promoted by the reduction in diameter in the transitional area between the massive portion 16 and the wing portion 17 already described above. This spoon-like shape of the wings 11 can best be seen in FIG. 5. It must also be noted that a variation of this exemplary embodiment is to transfer this spoon-like contour to the first exemplary embodiment so that a third exemplary embodiment is created, which is not shown in Figures here, but which can be referred to as a hybrid design between the first and second exemplary embodiments.

Furthermore, this second exemplary embodiment differs from the first exemplary embodiment in that the wings transition from their proximal ends directly into the massive portion 16 of the applicator and do not first transition into a closed ring wall forming a cavity that is open substantially only for its proximal end face.

However, the wings still form a cavity 5 between them which acts as a mass storage unit, just as in the first exemplary embodiment.

Furthermore, it is to be noted with particular emphasis that the statements regarding the elasticity and wall thickness of the wings in the context of the first exemplary embodiment apply also in this case.

Another difference that attracts attention immediately when viewing the FIGS. 5 to 8 is that the wings in this second exemplary embodiment are not divided into a stem portion and a head portion, as in the first exemplary embodiment. Instead, the wings 11 are preferably configured in such a way that they continuously widen at first towards the distal end, viewed in the circumferential direction, and then transition into a round arc at the very distal end. This results in a gap 13, which continuously narrows from the distal end of the wing 11 towards the proximal end of the wing 11 and which is configured in an approximate V-shape, remaining free between immediately adjacent wings in their state of rest.

With respect to the rounded portion of the distal end region of the wings, the statements of the first exemplary embodiment again apply.

Fourth Exemplary Embodiment

Above, a third exemplary embodiment has already been disclosed verbally with introducing Figures depicting this third embodiment graphically.

FIGS. 10 to 14 show therefore a fourth exemplary embodiment of the invention. As regards their function, the two exemplary embodiments are identical, so that the statements on the second exemplary embodiment also apply to this fourth exemplary embodiment unless otherwise provided by the differences between the two exemplary embodiments described hereinafter.

The first difference clearly visible from the Figures lies in the fact that again six wings are used in this exemplary embodiment instead of the four wings of the second exemplary embodiment. However, the wings are disposed in their entirety with their wing roots along an annular line 12 also in this exemplary embodiment, so that these wings also form a cavity 5 between them, see the dotted line in FIG. 14.

Figure 12:
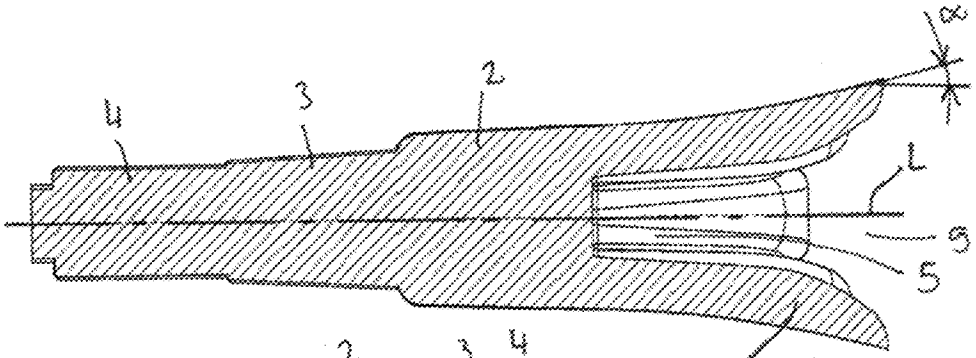
FIG. 12 shows a sectional view along the longitudinal axis L for the fourth exemplary embodiment.
Figure 10:
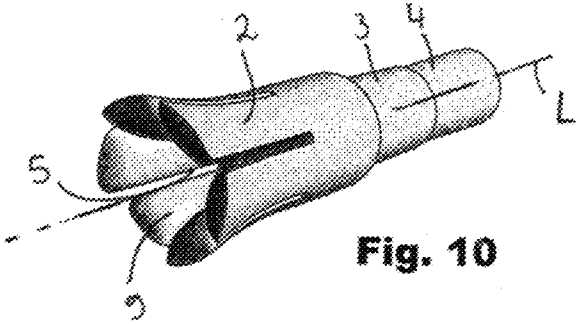
FIG. 10 shows a perspective view for the fourth exemplary embodiment, obliquely from the front.
Figure 11:
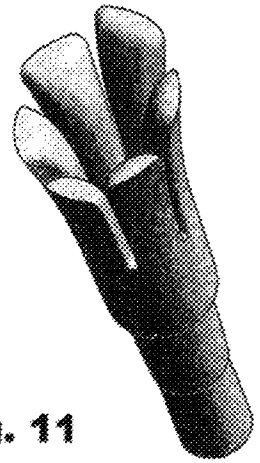
FIG. 11 shows a perspective view for the fourth exemplary embodiment, obliquely from above.
Figure 14:
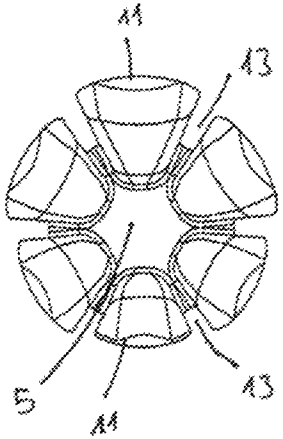
FIG. 14 shows a frontal view for the fourth exemplary embodiment from the front viewing into the cavity.

The applicator body 2 is divided into a massive portion 16 and a wing portion 17 also in this exemplary embodiment, see FIG. 12.

Here, the massive portion 16 has a slightly conical shape, or is configured in such a way that its diameter increases in the direction towards the wing portion 17.

Another interesting difference is that the wings 11 in this exemplary embodiment have not been concavely curved in the circumferential direction, but preferably have a slightly convex curve, comparable to what is provided in the first embodiment. The wings 11 are also, just like in the first exemplary embodiment, concavely curved outwards over at least the predominant part of their length in a direction whose projection corresponds to the direction of the longitudinal axis.

Comparable to what is shown by the second embodiment, the fourth embodiment possesses wings that transition from their proximal ends directly into the massive portion 16 of the applicator, and do not first transition into a closed ring wall forming a cavity that is open substantially only for its proximal end face, see FIG. 12.

However, the wings still form a cavity 5 between them, which acts as a mass storage unit, just as in the first exemplary embodiment.

Furthermore, it is to be noted with particular emphasis that the statements regarding the elasticity and wall thickness of the wings in the context of the first exemplary embodiment apply also in this case.

Another difference that attracts attention immediately when viewing the FIGS. 10 to 14 is that the wings in this second exemplary embodiment are not divided into a stem portion and a head portion, as in the first exemplary embodiment. Instead, the wings 11 are preferably configured in such a way that they continuously widen at first towards the distal end, viewed in the circumferential direction.

At this point it has to be highlighted that each gap 13 confined in a circumferential direction by two adjacent wings has an essentially constant width in circumferential direction, that means that the width of the gap is at the distal end of the gap maximum 20% bigger than the width of the gap at the proximal end of the gap, close to the handle of the applicator.

Finally, this exemplary embodiment is characterized in that the maximum extension of the wings in a direction along the longitudinal axis is not identical. Instead, the wings have different maximum extensions in this direction. Preferably this difference is so big that the maximum extension of the longest wing is at least 20%, and preferably at least 33% bigger, compared to the maximum extension of the shortest wing.

Preferably, the wings are designed such that a maximum extension of neighboring wings increases stepwise from the shortest to the longest wing, and decreases stepwise from the longest to the shortest wing so that each wing—except for the longest one and the shortest one—is directly neighboured by a longer wing and a shorter one.

Special Applicator System

Figure 9:
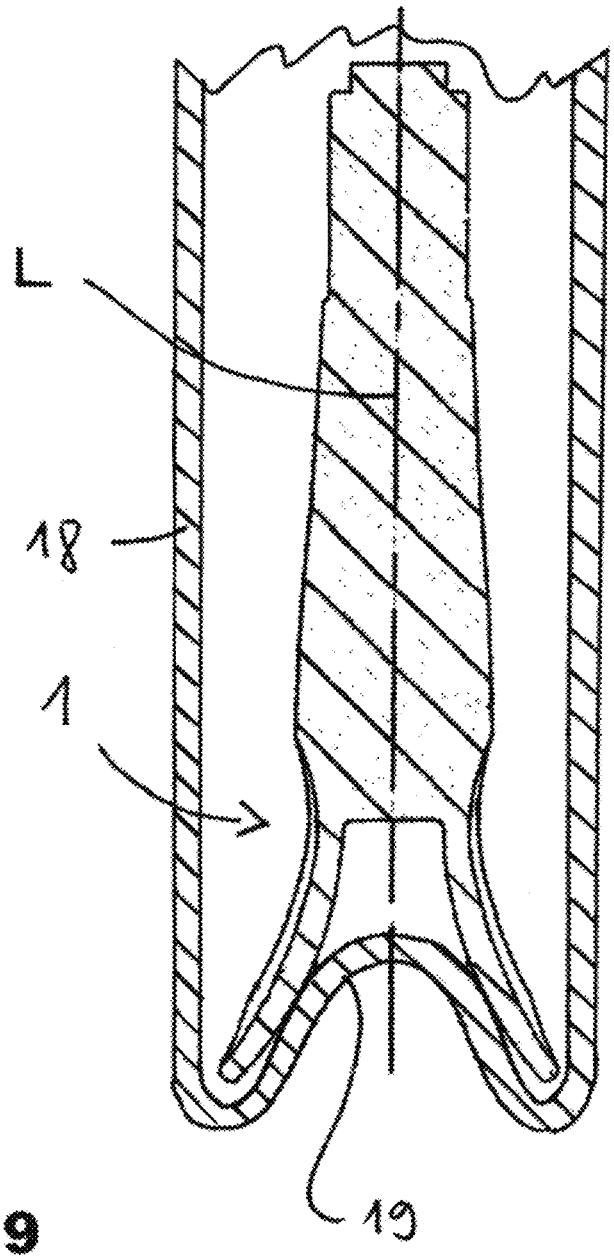
FIG. 9 shows an exemplary embodiment for the way in which the applicators according to the invention can be combined with a specially designed storage container to constitute a special applicator system.
Figure 13:
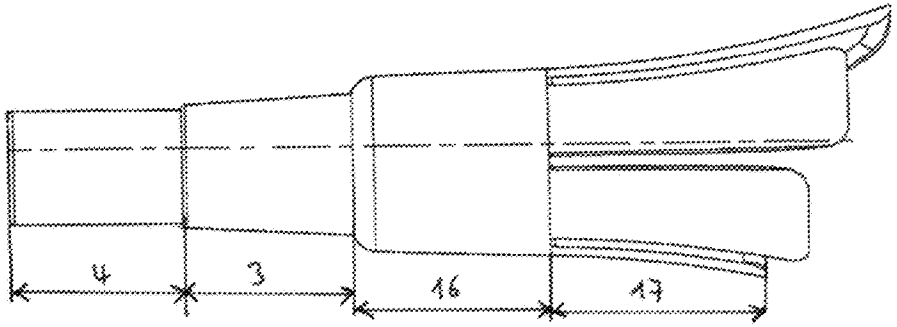
FIG. 13 shows a side view for the fourth exemplary embodiment.

FIG. 9 shows how the applicators according to the invention can be combined with a specially designed storage container 18 to constitute a special applicator system.

The storage container 18 is characterized in that it has a bottom-end projection 19. The bottom-end projection 19 can be formed by the bottom wall, which possibly extends with a completely or substantially constant wall thickness and is inverted in the direction of the interior of the container, or instead also by a bottom-end accumulation of material which results in a cone-like structure or "bump" protruding inwards from the inner side of the bottom.

The decisive factor is that the bottom-end projection protrudes into the space peripherally delimited by the wings when the applicator is completely inserted into the storage container. Thus, the bottom-end projection limits the mass volume that can be stored by the space peripherally delimited by the wings.

Because this system according to the invention is used particularly in the application of such substances that do not have an aqueous, but rather a pasty or creamy consistency, the supply of mass kept in storage between the wings is not refilled once the applicator is withdrawn from the bottom-end projection. Instead, the volume of the mass stored between the wings remains constant until the applicator reaches the wiper. In this manner, the mass storage capacity of the applicator can be determined by the design of the bottom-end projection. It must be noted that "remains constant" is understood to also mean changes of up to +/−15%, better only of up to +/−5%.

It must be noted that the bottom-end projection is preferably configured in such a way that, due to it protruding into the space peripherally enclosed by the wings, it reduces the storage volume thereof by at least 10%, better by at least 25%.

The applicator system is preferably configured in such a way that the bottom-end projection, in any case, protrudes into the space enclosed by the wings whenever the applicator has been brought into its storage position within the storage container, in which it is ready for the next use when the container is closed.

Protection is also sought for the use of an applicator according to the invention for the applicator system just described.

The invention claimed is:

1. A lip applicator for applying a cosmetic onto the skin, comprising:

an elongate applicator body extending along a longitudinal applicator axis and a bristle-free jacket surface surrounding the applicator body which serves, at least in some sections, for applying and distributing the cosmetic on the skin, wherein the applicator body has a plurality of wings that distally each have a freely projecting end and the ends of the wings are, in their entirety, disposed along an annular line and the wings form between them a mass storage unit, and an inner space enclosed peripherally by the wings has its maximum radial extent at a distal end of the wings, wherein at least one wing is flexible to a more than just insubstantial extent in a radially inward direction.

2. The applicator according to claim 1, wherein each of the wings extends obliquely outwards relative to the longitudinal applicator axis, and all wings extend obliquely outwards in different directions, wherein the wings are curved concavely outwards over at least a predominant part of their length or over their entire length in a direction whose projection corresponds to the direction of the longitudinal axis.

3. The applicator according to claim 1, wherein an outer surface of each wing is convexly curved in a circumferential direction.

4. The applicator according to claim 1, comprising 4 to 6 wings.

5. The applicator according to claim 1, wherein a region peripherally enclosed by the wings becomes increasingly larger, continuously, from wing roots towards distal ends of the wings.

6. The applicator according to claim 1, wherein the applicator is designed in such a way that distal ends of the wings are adapted to not touch when passing a wiper.

7. The applicator according to claim 1, wherein each of the wings has an end rounded in a circumferential direction, and a region over which the rounded portion extends is at least 1/16 of a length of a wing from a distal wing tip to a proximal wing root.

8. The applicator according to claim 1, wherein a wall thickness of each wing, measured perpendicularly to, a local surface; is less than or equal to 1.25 mm.

9. The applicator according to claim 1, wherein a gap, which narrows from a distal end of the wing towards a proximal end of the wing and which is configured in an approximate V-shape, remains free between immediately adjacent wings in their state of rest.

10. The applicator according to claim 1, wherein the wings each have a stern portion and a head portion, and wherein the head portion, at least substantially, has a larger extent in a circumferential direction than the stem portion.

11. The applicator according to claim 1, wherein the wings transition at their proximal end into a ring wall, which is substantially closed in a circumferential direction and which forms a cavity that is open substantially only at its proximal end face.

12. The applicator according to, claim 1, wherein the wings make up at least ⅓ of a length of the applicator body in a direction parallel to the longitudinal applicator axis and the wings make up a maximum of ⅔ of the length of the applicator body in the direction parallel to the longitudinal applicator axis.

13. The applicator according to claim 1, wherein a surface that is adapted to come into contact with the skin and with a substance to be applied during application as intended is a smooth plastic surface.

14. The applicator according to claim 1, wherein a surface that is adapted to come into contact with the skin and with a substance to be applied dining the application as intended is equipped with a flocked coating.

15. An application system comprising the applicator according to claim 1 and a storage container, wherein the storage container has a bottom-end projection and the storage container and the applicator are matched to each other in such a way that the bottom-end projection protrudes into a space peripherally delimited by the wings when the applicator is completely inserted into the storage container.

16. The applicator according to claim 1, wherein an extension of individual wings in a longitudinal direction is different, such that each wing —except for a longest wing and a shortest wing —is directly neighboured by a longer wing and a shorter wing.

17. A lip applicator for applying a cosmetic onto the skin, comprising:

an elongate applicator body extending along a longitudinal applicator axis and a bristle-free jacket surface surrounding the applicator body which serves, at least in some sections, for applying and distributing the cosmetic on the skin, wherein the applicator body has a plurality of wings that distally each have a freely projecting end and the ends of the wings are, in their entirety, disposed along an annular line and the wings form between them a mass storage unit, and an inner space enclosed peripherally by the wings has its maximum radial extent at a distal end of the wings, wherein each of the wings extends obliquely outwards relative to the longitudinal applicator axis, and all wings extend obliquely outwards in different directions, wherein the wings are curved concavely outwards over at least a predominant part of their length or over their entire length in a direction whose projection corresponds to the direction of the longitudinal axis.

18. A lip applicator for applying a cosmetic onto the skin, comprising:

an elongate applicator body extending along a longitudinal applicator axis and a Bristle-free jacket surface surrounding the applicator body which serves, at least in some sections, for applying and distributing the cosmetic on the skin, wherein the applicator body has a plurality of wings that distally each have a freely projecting end and the ends of the wins are, in their entirety, disposed along an annular line and the wings form between them a mass storage unit, and an inner space enclosed peripherally by the wings has its maximum radial extent at a distal end of the wings, wherein the wings each have a stem portion and a head portion, and wherein the head portion, at least substantially, has a larger extent in a circumferential direction than the stem portion.

* * * * *